US006047569A

United States Patent [19]

Shima

[11] Patent Number: 6,047,569

[45] Date of Patent: Apr. 11, 2000

[54] METHOD FOR HOLDING A STITCH LOOP

[75] Inventor: Masahiro Shima, Wakayama, Japan

[73] Assignee: Shima Seiki Manufacturing, Ltd., Wakayama, Japan

[21] Appl. No.: 09/084,179

[22] Filed: May 26, 1998

[30] Foreign Application Priority Data

May 27, 1997 [JP] Japan ..... 9-136956

[51] Int. Cl.[7] ..... D04B 7/04

[52] U.S. Cl. ..... 66/64; 66/60 R

[58] Field of Search ..... 66/60 R, 64, 70, 66/71, 75.1, 76, 77, 78, 120, 96 R, 148

[56] References Cited

U.S. PATENT DOCUMENTS

| | | | |
|---|---|---|---|
| 4,012,927 | 3/1977 | Kuhnert | 66/78 |
| 4,474,037 | 10/1984 | Kuhnert | 66/78 |
| 4,637,228 | 1/1987 | Shima | 66/75.1 |
| 4,643,003 | 2/1987 | Schmodde | 66/78 |
| 4,905,483 | 3/1990 | Shima | 66/64 |
| 5,343,719 | 9/1994 | Nakamori et al. | 66/78 |
| 5,365,756 | 11/1994 | Nakamori et al. | 66/64 |
| 5,367,892 | 11/1994 | Shima et al. | 66/78 |
| 5,398,527 | 3/1995 | Hirai et al. | 66/64 |
| 5,423,204 | 6/1995 | Shima et al. | 66/109 |
| 5,557,948 | 9/1996 | Shima et al. | 66/64 |

*Primary Examiner*—L. Worrell, Jr.
*Attorney, Agent, or Firm*—Nikaido, Marmelstein, Murray & Oram, LLP

[57] ABSTRACT

Compound needles, each comprising a needle proper having a hook at the top end thereof and a slider including two thin plates put together are arranged in a pair of needle beds, and the needle proper and the slider of each compound needle can be moved forward and backward independently of each other. The needle proper of the compound needle of the first bed is moved forward into the trick gap. Then the slider is removed forward further to move the stitch loop from the hood of the needle proper onto the tongue of the slider. Both the hook and tongue of the compound needle of the second bed are inserted into the stitch loop being kept on the tongue of the slider of the first bed. Then the slider of the compound needle of the first bed is moved backward to deliver the stitch loop onto the tongue of the slider of the second bed. After other knitting is made by the compound needle of the first bed, the hook thereof is inserted into the stitch loop being held on the tongue of the slider of the second bed to move the stitch loop again.

10 Claims, 11 Drawing Sheets

FIG. 1-a
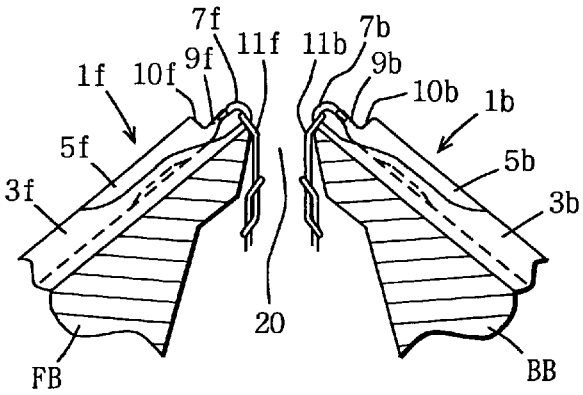
FIG. 1-b
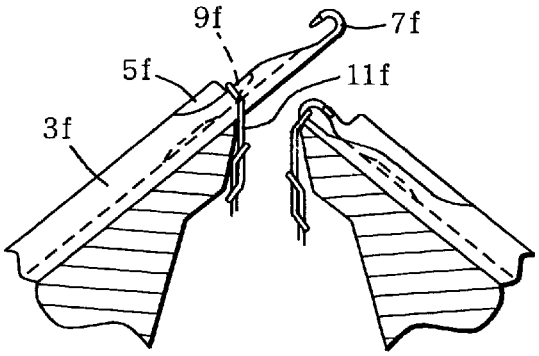
FIG. 1-c
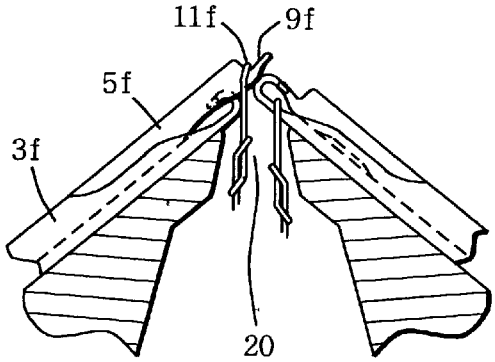
FIG. 1-d
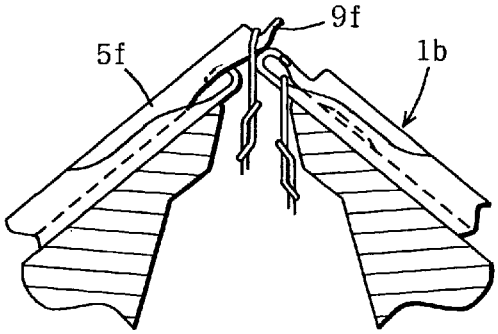
FIG. 1-e
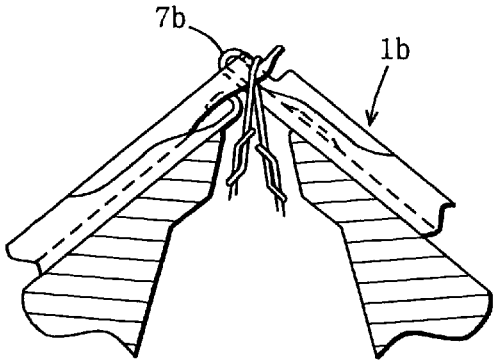
FIG. 1-f
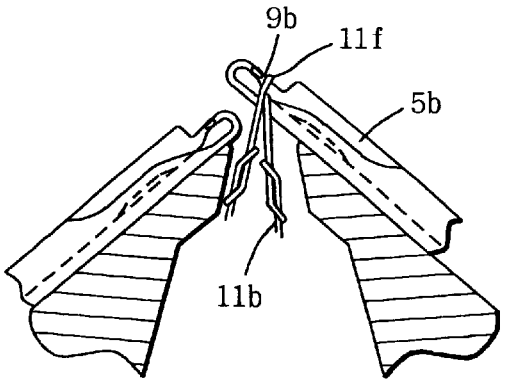

FIG. 2-a
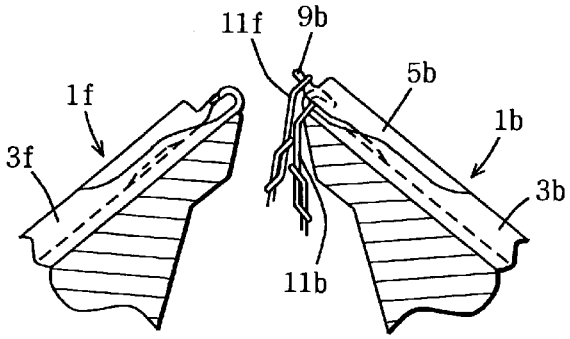
FIG. 2-b
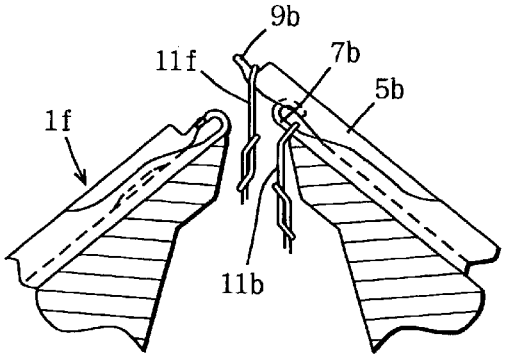
FIG. 2-c
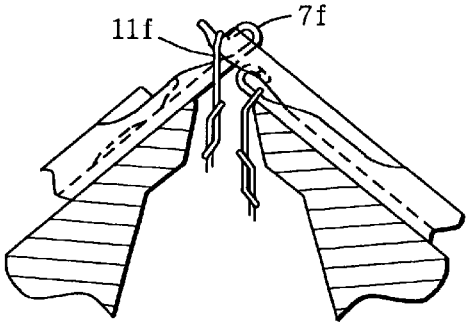
FIG. 2-d
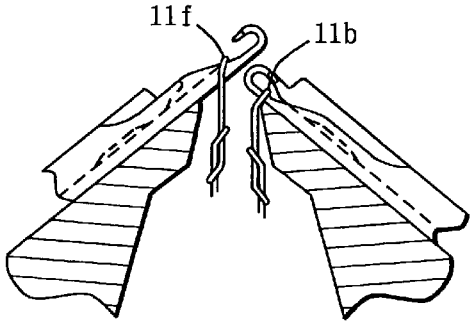
FIG. 2-e
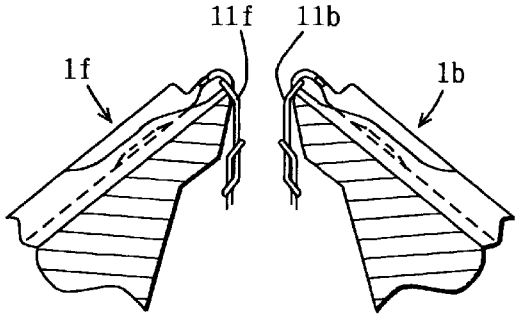

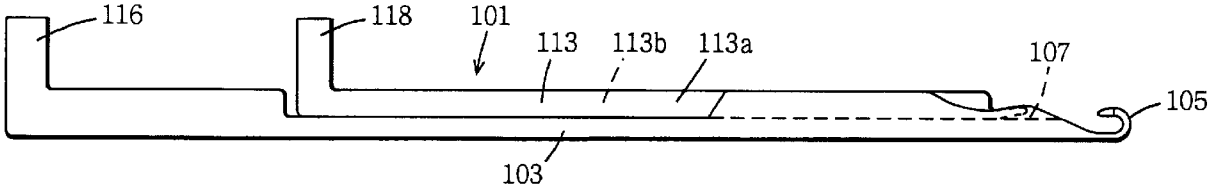
FIG. 11-a
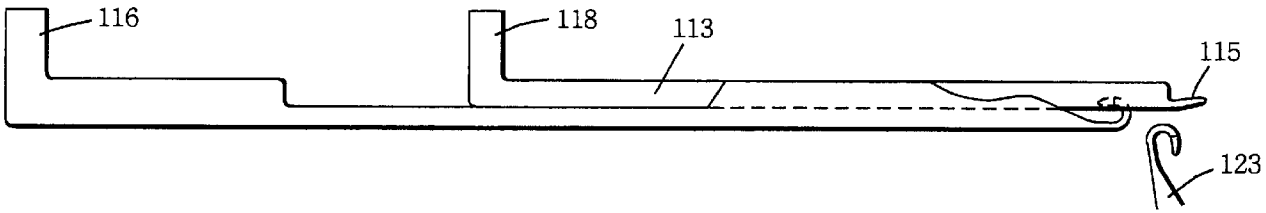
FIG. 11-b
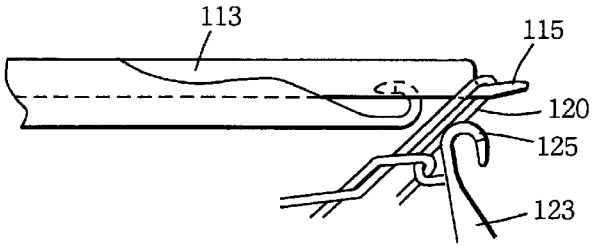
FIG. 11-c
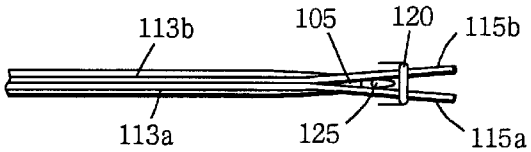
FIG. 11-d

METHOD FOR HOLDING A STITCH LOOP

FIELD OF THE INVENTION

The present invention relates to a knitting method used with a flat knitting machine having compound needles, and in particular, relates to a method for holding a stitch loop, that is kept on a needle or a transfer jack, temporarily on a needle keeping another stitch loop.

PRIOR ART

In the present specification, "holding" a stitch loop does not mean a conventional "transfer" of a stitch loop onto a hook of another needle. In the conventional transfer, if the receiving needle is keeping a stitch loop, a double stitch will be formed on the hook of the receiving needle, and that double stitch can not be separated. In contrast to this, in the holding, the receiving needle keeps the stitch loop that it has been keeping and the newly received stitch loop apart from each other; the receiving needle keeps the stitch loop, that it has been keeping, on the hook of the needle proper thereof, and keeps the received stitch loop on the tongue of the slider thereof. Accordingly, "transfer" and "holding" have different meanings in the following.

A conventional flat knitting machine has a configuration of the so-called two-needle-bed flat knitting machine in which a pair of needle beds having a large number of needles are arranged to face each other, one in the front and the other in the rear, with a trick gap between them. When this flat knitting machine is used, stitch loops are formed by using needles of the respective needle beds, and a stitch loop formed on each needle bed can be transferred onto a needle of the other needle bed, and a variety of knitted fabrics can be formed by combining stitch formation and transfer.

Needles that are used in flat knitting machines include latch needles and compound needles. A compound needle, wherein a slider and a needle proper are moved relative to each other to open and close the hook, can reduce the stroke of the forward and backward movements of the needle to about one half of that of the latch needle. Hence the use of compound needles can reduce the size of the flat knitting machine, and this in turn will improve the productivity. Up to the present, a variety of types of compound needles have been investigated. Of these compound needles, there are those of which sliders have a stitch loop transferring function, for example, German Patent No. 2228547 and Japanese Patent Sho 62-19535. FIG. 11 schematically shows a compound needle of this kind.

A needle proper 103 of a compound needle 101 has a hook 105 at the top end, and has a slider-receiving groove 107 in the rear of the hook 105, said slider-receiving groove 107 containing a slider 113 and supporting the slider 113 in such a way that the slider 113 can be moved forward and backward in the sliding direction of the needle proper 103. The slider 113 comprises two thin plates of the same configuration 113*a,* 113*b* that are put together. The slider 113 is contained in the slider-receiving groove 107 formed in said needle proper 103. A tongue 115 is formed at the top end of the slider 113, said tongue 115 being able to advance to a position beyond the hook of said needle proper. Control butts 116, 118 are formed on the needle proper 103 and the slider 113, respectively, to protrude out of the needle groove. When these control butts are made to engage with cams provided on a carriage that travels over the needle bed, the needle proper and the slider will be moved relative to each other and their advancements into the trick gap will be controlled to effect a variety of knitting such as stitch formations of knitting, tacking and missing and transfer. FIG. 11-*b* is a side view showing a state at the time of transfer when the slider is advanced beyond the hook of the needle proper. FIG. 11-*c* is an enlarged view of a part of FIG. 11-*b,* and FIG. 11-*d* is a plan view of FIG. 11-*c.* When the tongue 115 of the slider 113 advances beyond the hook 105, the tip of the tongue 115 will be separated by the hook 105, and the tongue 115 under this separated condition will move forward beyond the hook 105. A stitch loop 120 on the tongue 115 will be pushed up to and over the trick gap and to the position of transfer by the separated and expanding tongue 115. A hook 125 of a needle proper 123 of the other needle bed is made to penetrated into the stitch loop 120 being kept on the expanded tongue 115 of the slider 113 to receive the stitch loop 120 into the hook 125.

In knitting a fabric, any needles may be used. For example, when the needles of only the front needle bed are used, a fabric of plain stitch (face stitch) will be knitted. When the yarn is fed to the needles of both the front and back needle beds in zigzag, a fabric of rib knit will be knitted. When the yarn is fed to needles of the front needle bed and in succession to the needles of the back needle bed to make circumferential knitting, a tubular fabric, in which the front fabric and the back fabric are joined at both ends thereof, will be knitted.

When face stitch and back stitch are mixed in the same wale, or when a stitch loop is moved to overlap it with an adjacent stitch loop, empty needles of the opposing needle bed are used. When a pattern in which face stitch and back stitch are mixed together, for example, when a links pattern is knitted, a stitch loop is formed on the front needle bed, then this stitch loop is transferred to a needle of the opposing back needle bed, then a stitch loop of the remaining course is formed on the same needle bed, and in subsequent knitting, stitch loops are reciprocated between the front and back needle beds to knit the subsequent course. When structural pattern knitting or integral knitting is made, a stitch loop is transferred onto an empty needle of the other needle bed, then the needle bed is racked, and this transferred stitch loop is transferred onto a needle, that is adjacent to the initial needle of the needle bed, and overlapped with a stitch loop that is kept on the adjacent needle.

In knitting a plain stitch fabric or a wide rib fabric, as the opposing needles are empty needles, they can be used. However, in knitting a full-rib-stitch fabric or a tubular fabric, that is knitted by using all the needles of the front and back needle beds, empty needles for transferring stitch loops are not available, and the above-mentioned knitting can not be made. In such a case, empty needles must be provided by using, for example, a flat knitting machine that is provided with, in addition to the front and back needle beds, an auxiliary bed (transfer jack bed) containing transfer jacks as knitting members dedicated to transfer (EP 603 005 A2), or a so-called flat knitting machine with four needle beds, in which another pair of needle beds is provided above the front and back needle beds.

As described above, in the prior art, for transferring a stitch loop between two needle beds, it was considered to be an essential condition that an empty needle is present on the other needle bed and it was believed that it is not possible to knit a fabric without providing empty needles. These fixed ideas put considerable restrictions on the development of diversification of knitting. In the prior art, when a stitch loop is transferred to a needle that is keeping another stitch loop, these stitch loops will become a double stitch that can not be separated anymore, and this poses a problem to the above-mentioned transfer jack bed and four-bed flat knitting machine that is common to the two-bed flat knitting machine.

SUMMARY OF THE INVENTION

The task of the present invention is to provide a new method for holding a stitch loop that requires no empty needle, and the objective of the present invention is to destroy the above-mentioned fixed ideas concerning knitting fabrics and achieve a greater diversity of knitting or new knitted structures and labor saving in knitting.

The method for holding a stitch loop according to the present invention is a method for holding a stitch loop using a flat knitting machine wherein a large number of compound needles, each comprising a needle proper with a hook at a top end thereof and a slider having a tongue consisting of two thin plates put together, are arranged in at least one first bed, the needle proper and the slider of said compound needle are individually movable forward and backward, at least one second bed with a large number of knitting members is provided, and said compound needles are made to advance from the first bed, and said knitting members are made to advance from the second bed to cross said compound needles and said knitting members with each other, and a region where said compound needles and said knitting members cross form a trick gap, said method for holding a stitch loop is characterized in that it includes a: a step of moving a knitting member keeping a stitch loop from the second bed into the trick gap;

b: a step of moving the needle proper and the slider of a compound needle forward into the trick gap and inserting both said hook and said tongue into the stitch loop kept by the knitting member of step a, and c: a step of moving the knitting member referred to in step a backward and placing the stitch loop onto the tongue of the compound needle of step b.

Preferably, in said step b and step c, another stitch loop is kept on the hook of said compound needle referred to in steps b and c.

Preferably, said method further includes, in succession to said step c, d: a step of moving backward both the needle proper and the slider of the compound needle of step c and keeping said stitch loop on the tongue of step c;

e: a step of making other knitting with the knitting member of step c;

f: a step of moving the slider of the step d forward into the trick gap;

g: a step of moving the knitting member of step e forward into the trick gap and inserting a top end thereof between two thin plates forming the tongue of the slider of step f; and h: a step of moving the slider of step g backward and transferring said stitch loop to the knitting member of step g.

Furthermore, preferably, in said second bed, a large number of compound needles are arranged as knitting members, said compound needle comprising a needle proper with a hook at a top end thereof and a slider having a tongue consisting of two thin plates put together, and said step a is effected by, with said stitch loop being kept on the hook of the compound needle of the second bed, moving forward the needle proper of the compound needle of the second bed, then moving forward the slider of the compound needle of the second bed, and shifting, during this time, said stitch loop from the hook of said needle proper onto the tongue of said slider, and said step b is effected by inserting both the hook and the tongue of the compound needle of the first bed between two thin plates constituting the tongue of the slider of the compound needle of said second bed, and said step c is effected by moving the slider of the compound needle of said second bed backward.

Or said each knitting member is a transfer jack, and said second bed is a transfer jack bed in which a large number of said transfer jacks are arranged.

In one aspect of the present invention, the stitch loop is held on the tongue of the compound needle, and another stitch loop can be kept on the hook of the same compound needle. Accordingly, even when two stitch loops are kept on one compound needle, these stitch loops do not become a double stitch; they remain to be separated as independent stitch loops. The knitting member of the side that gave the stitch loop to the compound can make a knitting operation as fit during this time, and after that the knitting member will receive the stitch loop from the compound needle to keep it. Thus while the knitting member makes a knitting operation, the stitch loop thereof can be kept by the compound needle, and this enhances the diversity of knitting. A compound needle is used on the side that receives a stitch loop, whereas a transfer jack, a latch needle, a compound needle, etc. are used on the side that gives the stitch loop. In the following, a compound needle may be simply called a needle.

BRIEF DESCRIPTION OF THE DRAWINGS

FIGS. 1*a–f* shows steps of moving a stitch loop from a needle of a front needle bed and holding it on a needle of a back needle bed. FIG. 1-*a* shows the initial state. FIG. 1-*b* shows that the hook is moved forward. FIG. 1-*c* shows that the hook is moved backward and the slider is moved forward. FIG. 1-*d* shows that the slider is moved forward further. FIG. 1-*e* shows that the opposing needle is moved forward. FIG. 1-*f* shows that holding on the opposing needle is completed.

FIGS. 2*a–e* shows steps for returning the stitch loop from the needle of the back needle bed to the needle of the front needle bed. FIG. 2-*a* shows that the needle that received the stitch loop is moved backward. FIG. 2-*b* shows that the slider of the needle that received the stitch loop is moved forward. FIG. 2-*c* shows that the hook of the initial needle is moved forward. FIG. 2-*d* shows that the needle that received the stitch loop is moved backward. FIG. 2-*e* shows that returning is completed.

FIGS. 11*a–d* schematically shows an example of compound needle. FIG. 11-*a* shows the normal state of the compound needle. FIG. 11-*b* shows that the slider is moved forward. FIG. 11-*c* shows an enlarged view of a part of the compound needle during transfer. FIG. 11-*d* is an enlarged plan view of the part of the compound needle during transfer.

EMBODIMENT

Figure 3:
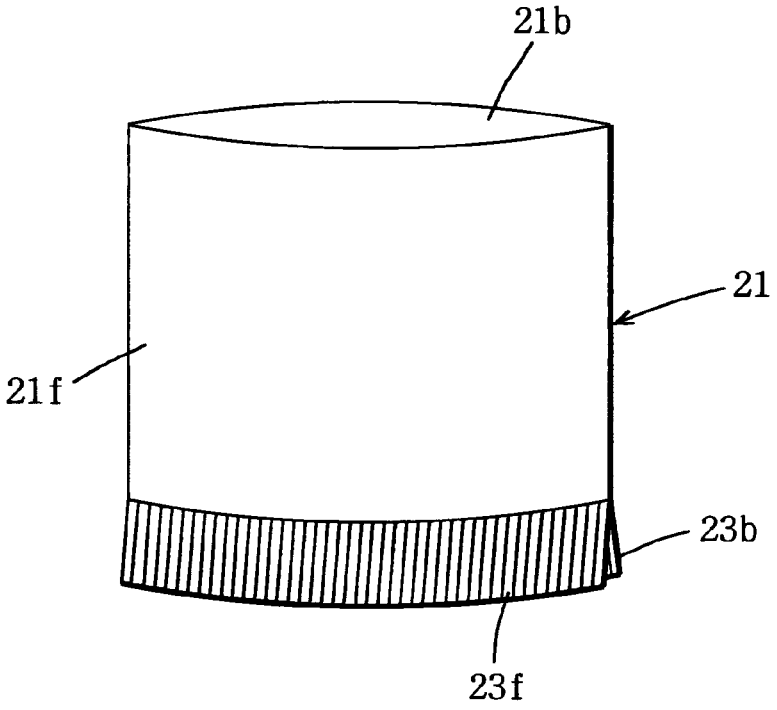
FIG. 3 shows a knitted fabric wherein rib hem parts are knitted on a body of tubular knitting, as an embodiment of knitting using the method of holding a stitch loop.

In the following, with reference to the attached drawings, an embodiment of the method of holding a stitch loop according to the present invention will be described.

Embodiment 1

Basic Knitting with Holding

FIGS. 1*a–f* and FIGS. 2*a–d* show the basic knitting for moving a stitch loop from a needle of the front needle bed to and keeping on a needle of the back needle bed; the steps are seen from the side of the flat knitting machine. Compound needles 1*f,* 1*b* of the above-mentioned type are arranged in the front and back needle beds FB, BB. These compound needles 1*f,* 1*b* comprise needles proper 3*f,* 3*b* having hooks 7*f,* 7*b* at the top ends thereof and sliders 5*f,* 5*b* having tongues 9*f,* 9*b* at the top ends thereof. 10*f* and 10*b* are differences in level in the rear of the tongues 9*f,* 9*b.* These differences prevent stitch loops kept on the tongues 9*f,* 9*b* from sliding away to the rear of the sliders 5*f,* 5*b.* Although not illustrated, these needles proper 3*f,* 3*b* and sliders 5*f,* 5*b* are provided with control butts, respectively, and they are driven individually by cams provided on carriages that reciprocate over the needle beds. Otherwise, the needle proper and the slider of each needle are independently connected to linear drive mechanisms, and these drive mechanisms are driven independently of each other. Thus the needles proper and the sliders are moved relative to each other by appropriate means to effect knitting.

FIG. 1-*a* shows the initial state; the compound needles 1*f,* 1*b* keep stitch loops 11*f,* 11*b* in the hooks 7*f,* 7*b,* respectively. First, the needle proper 3*f* of the compound needle 1*f* of the front needle bed FB is moved forward. As a result of this, the needle proper 3*f* and the slider 5*f* are moved relative to each other, and the stitch loop 11*f* that was kept on the hook 7*f* is guided onto the tongue 9*f* of the slider 5*f* (FIG. 1-*b*). Next, the slider 5*f* is moved forward and the needle proper 3*f* is moved backward to keep the stitch loop 11*f* by the tongue 9*f* of the slider 5*f.* As a result, the stitch loop 11*f* is placed on the tongue 9*f* of the slider 5*f* and pushed up beyond the hook 7*f* above the trick gap 20 (FIG. 1-*c*). At this time, if the needle proper 3*f* is moved a little more forward towards the trick gap 20 than the state shown in FIG. 1-*a,* the slider 5*f* keeping the stitch loop 11*f* can be reliably guided and prevented from swaying. This position of the needle proper 3*f* is a little lower than the crossing position so that the hook 7*f* thereof does not interfere with the course of the forward movement of the opposing receiving needle. At this time, the opposing needle 1*b* of the back needle bed BB is moved forward to the position illustrated in the diagram. Next, the slider 5*f* of the needle 1*f* of the front needle bed FB is moved forward further to the position where the stitch loop is passed to the other needle (FIG. 1-*d*). The needle 1*b* of the back needle bed BB is standing by in the position illustrated in the diagram, and can be easily moved forward into the stitch loop 11*f* that is being kept by the needle 1*f.* After that, the needle 1*b* of the receiving side is moved forward further to enter into the tongue 9*f* of the slider that has been separated and expanded into two parts by the hook 7*f* of the needle 1*f* of the giving side and penetrate through the stitch loop 11*f* being kept on the tongue 9*f* (FIG. 1-*e*). As for the needle 1*b* that is to receive the stitch loop 11*f,* the top end of the hook 7*b* and the tongue 9*b* of the slider 5*b* are made to contact with each other to close the hook, and the needle 1*b,* that is holding the stitch loop 11*b* on the hook, is moved forward. With this arrangement, when the needle 1*b* receives the stitch loop 11*f,* problems such as inadvertent dropping of the stitch loop 11*f* into the hook can be prevented. It, however, is not essential to contact the hook 7*b* and the tongue 9*b* with each other. After that, the slider 5*f* of the needle 1*f* of the giving side, that has been moved forward to the giving & receiving position, is moved backward to release the stitch loop 11*f* from the slider 5*f* of the needle 1*f* of the front needle bed FB and hold the stitch loop 11*f* on the tongue 9*b* of the slider 5*b* of the needle 1*b* of the back needle bed BB (FIG. 1-*f*). Next, the needle proper 3*b* and the slider 5*b* of the needle 1*b,* that has received the stitch loop 11*f,* of the back needle bed BB are moved backward (FIG. 2-*a*). The slider 5*b* is set in a position where the stitch loop 11*f* being held on the tongue 9*b* does not slip off from the tongue 9*b* and the slider 5*b* does not collide with the opposing needle when it is moved forward in a subsequent step of knitting. In the present embodiment, the slider 5*b* is a little beyond the hook 7*b* of the needle proper 3*b* that has been moved backward.

As described above, the stitch loop 11*f* which was kept by the needle 1*f* of the front needle bed FB is now held on the slider tongue 9*b* of the opposing needle 1*b* of the back needle bed BB. As a result, the needle 1*b* of the back needle bed BB keeps the stitch loop 11*b,* that has been kept by the needle 1*b,* on its hook 7*b* and also keeps the stitch loop 11*f,* that was received just now, on the tongue 9*b* of the slider 5*b.* In this way, the stitch loop 11*f* is passed from the needle 1*f* of the front needle bed FB to and held by the opposing needle 1*b* of the back needle bed BB.

While this stitch loop is held on the needle 1*b* of the back needle bed BB, the needle 1*b* keeps the state shown in FIG. 2-*a,* and the needle 1*b* of the front needle bed FB, that released the stitch loop 11*f* and is an empty needle now, can be used to effect the subsequent knitting to knit the desired fabric.

After this knitting, as will described in the following, the stitch loop 11*f* that has been held is moved back to the original needle 1*f* of the opposing needle bed FB. First, the slider 5*b* of the needle 1*b* of the back needle bed BB, on which the stitch loop 11*f* has been held, is moved forward to the position of delivery, and the stitch loop 11*f* is pushed up over the trick gap 20 (FIG. 2-*b*). Next, the needle 1*f* ofthe front needle bed FB is moved forward, with the hook of the needle 1*f* being open, to go into the tongue 9*b* of the slider 5*b* and pierce the stitch loop 11*f* being kept on the tongue 9*b* (FIG. 2-*c*). After that, the needle 1*b* of the back needle bed BB, on which the stitch loop 11*f* has been held, is moved backward to deliver the stitch loop 11*f* to the needle 1*f* of the front needle bed FB (FIG. 2-*d*). Next, the needle 1*f* of the front needle bed FB, that has received the stitch loop 11*f,* is moved backward (FIG. 2-*e*). As a result, each of the needles 1*f,* 1*b* of the front and back needle beds FB, BB keeps one stitch loop 11*f,* 1*b.* Naturally, another stitch loop may be kept on the needle of the front needle bed, depending on the knitting that is made between FIG. 2-*a* and FIG. 2-*b.* The needle that receives the stitch loop that has been held is not necessarily the needle that originally released the stitch loop for holding.

This holding of a stitch loop is not limited to one from a needle of one needle bed to a needle of the other needle bed. For example, in a flat knitting machine with a transfer jack bed, a stitch loop may be delivered, via a transfer jack, for holding on an adjacent needle of the same needle bed or on a needle of the other opposing needle bed.

Applications

Next, two knitting examples that use this method for holding a stitch loop will described.

Application 1

Figure 4:
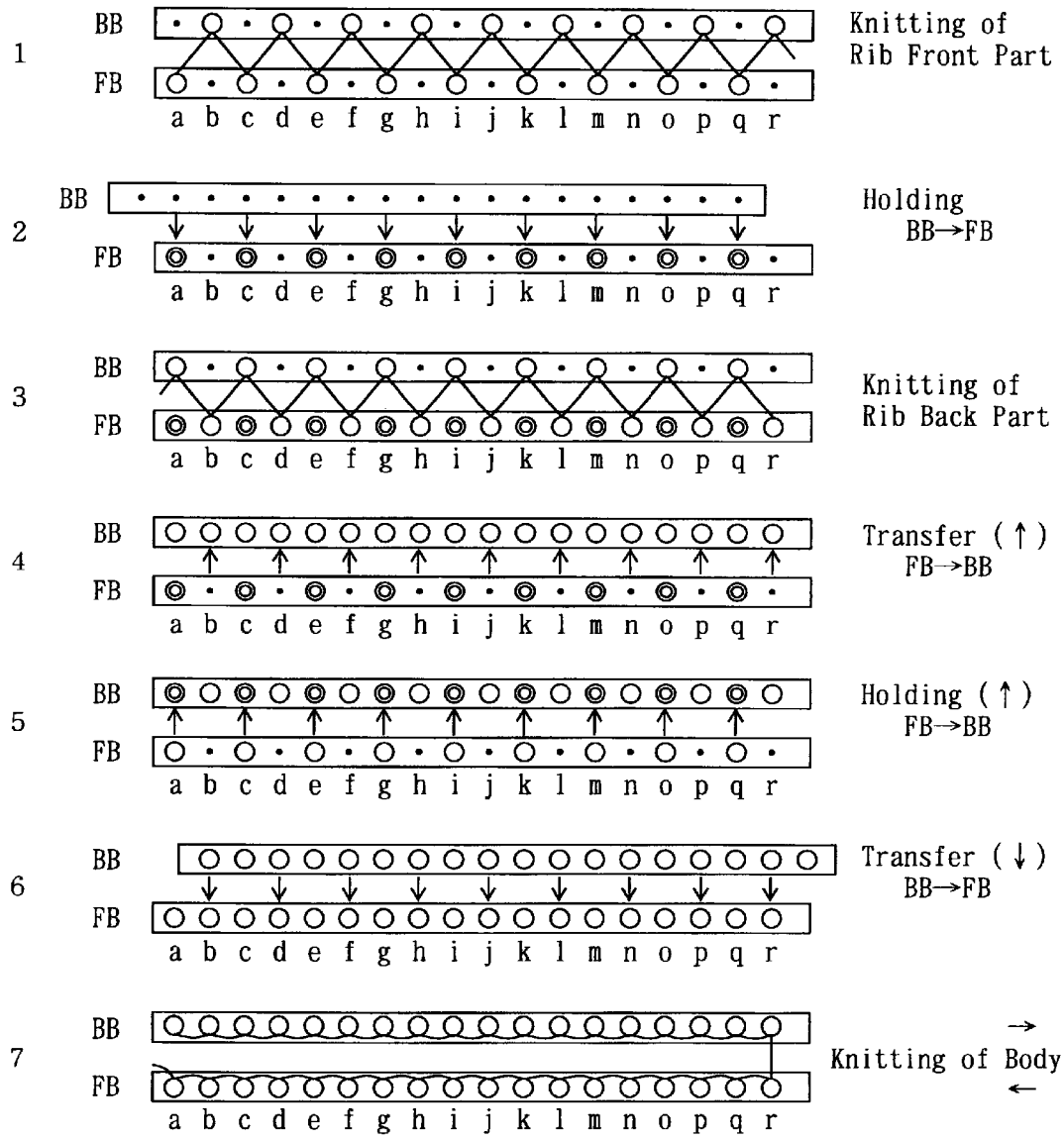
FIG. 4 shows knitting steps from the rib hem part through the body as Application 1.

A front body 21*f* and a back body 21*b,* both being plain stitch fabrics, are connected at both sides to form a body 21 of tubular knitting. Rib hem parts 23*f*, 23*b* of 1×1 rib knit are knitted on the hems of the body 21. FIG. 3 shows the completed knitted fabric. FIG. 4 shows the knitting steps for the rib hem parts and the body. First, in step 1, the yarn is fed to the needles a, c, e, . . . of the front needle bed FB and the needles b, d, f, . . . of the back needle bed BB to knit a course of the rib hem part 23*f* of the front body 21*f* side. When the knitting of this step 1 is repeated for a desired number of times, the rib hem part 23*f* of the desired height will produced. Next, in step 2, stitch loops knitted on needles b, d, f, . . . of the back needle bed BB are moved to and held on the needles a, c, e, . . . of the front needle bed FB that are keeping stitch loops. This holding of stitch loops is done by the above-mentioned method. In the subsequent step 3, the 1×1 rib hem part 23*b* of the back body 21*b* is knitted, and this knitting is done with the needles a, c, e, . . . of the back needle bed BB and the needles b, d, f, . . . of the front needle bed FB. Like the rib hem part 23*f* of the front body 21*f* side of the above-mentioned step 1, this knitting is repeated for the desired number of times to produce the rib hem part 23*b* of the desired height.

With the above-mentioned steps 1~3, knitting of the front and back rib hem parts 23*b*, 23*f* is completed, and in the subsequent steps 4~6, sorting by transfer of stitch loops to prepare for knitting of the body 21, that follows knitting of the rib hem parts 23, is made. In step 4, stitch loops of the rib hem part 23*b* of the back body 21*b*, that were knitted on the needles b, d, f, . . . of the front needle bed FB, are transferred onto empty needles b, d, f, . . . of the back needle bed BB. In the subsequent step 5, the stitch loops of the rib hem part 23*f* of the front body 21*f*, that were held in step 2, are held on needles a, c, e, . . . of the back needle bed, that are keeping stitch loops. After that, in step 6, the back needle bed BB is racked to the right to transfer the stitch loops that are being held to empty needles b, d, f, . . . of the front needle bed FB. As a result, the respective needles of the front and back needle beds keep stitch loops. After that, as shown in step 7, the yarn is circumferentially fed, clockwise, to the needles of the back needle bed BB then to the needles of the front needle bed FB to tubularly knit the body 21 in succession to the rib hem parts 23*f*, 23*b*.

Example that Uses Transfer Jack

Figure 5:
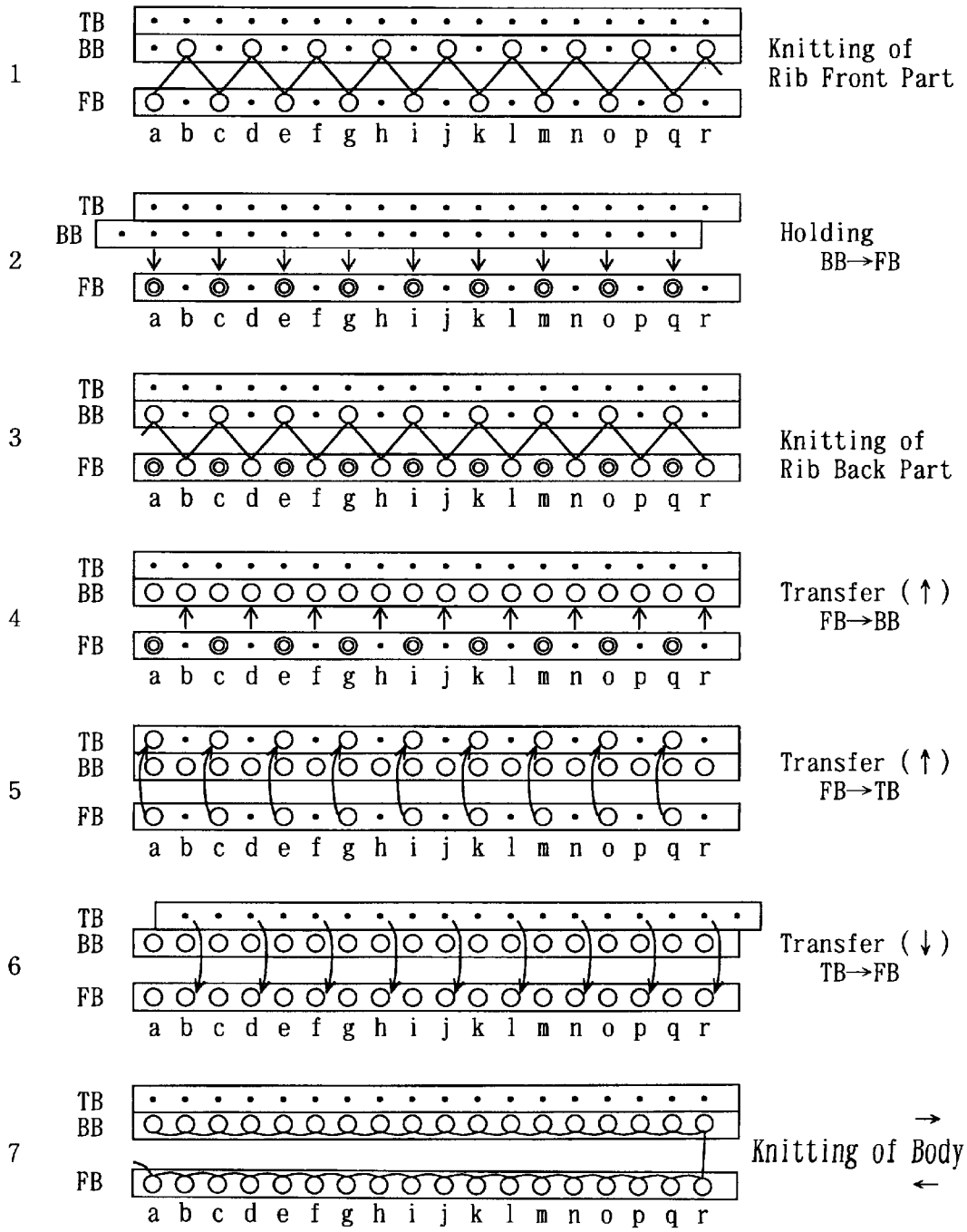
FIG. 5 shows knitting steps of a modification in which transfer jacks are used for holding.

FIG. 5 shows a knitting wherein a flat knitting machine with transfer jacks is used to make the above-mentioned knitting and holding of stitch loops are made via transfer jacks. In the knitting of the present embodiment, a transfer jack bed TB, that is arranged above a back needle bed BB, is used; as for beds, there are a pair of front and back needle beds with compound needles and a transfer jack bed. The transfer jack bed TB can be racked relative to both the back needle bed BB, that is beneath it, and the front needle bed FB, that is beneath and in front of it. As for holding, it is possible to move a stitch loop from the transfer jack bed TB and hold it on the front needle bed FB or the back needle bed BB, and it is also possible to move a stitch from the front needle bed FB and hold it on the back needle bed BB and vice versa. The transfer jack used here is an example of the knitting members other than the compound needle, and the latch needle, etc. may be used in place of the transfer jack. The structure of the transfer jack and that a transfer jack bed is placed above a needle bed and the transfer jack bed is racked relative to the needle bed beneath it are known well because of EP603005A2 of the present applicant. In place of a transfer jack bed, a bed with latch needles may be arranged above one of the pair of needle beds with compound needles or two beds with latch needles may be arranged above the pair of needle beds with compound needles.

In steps 1~4, knitting is made by the same method of FIG. 4 mentioned above, and in steps 5, 6, transfer of stitch loops is made by using transfer jacks of the transfer jack bed TB.

In the above-mentioned case, importance is attached to knitting efficiency, and at first one rib hem part is completed, then the other rib hem part is knitted. As a result, the rib hem parts 23*f*, 23*b* are separated between the front body and the back body, and are not formed into a complete tubular body. In place of the above-mentioned method, whenever a course of each rib hem part is formed, the stitch loops of the course may be held on adjacent needles of the same needle bed, and the rib hem part of the front body, the rib hem part of the back body, then the rib hem part of the front body, . . . may be knitted in this order to form the rib hem parts 23*f*, 23*b* into a complete tubular body.

Application 2

Figure 6:
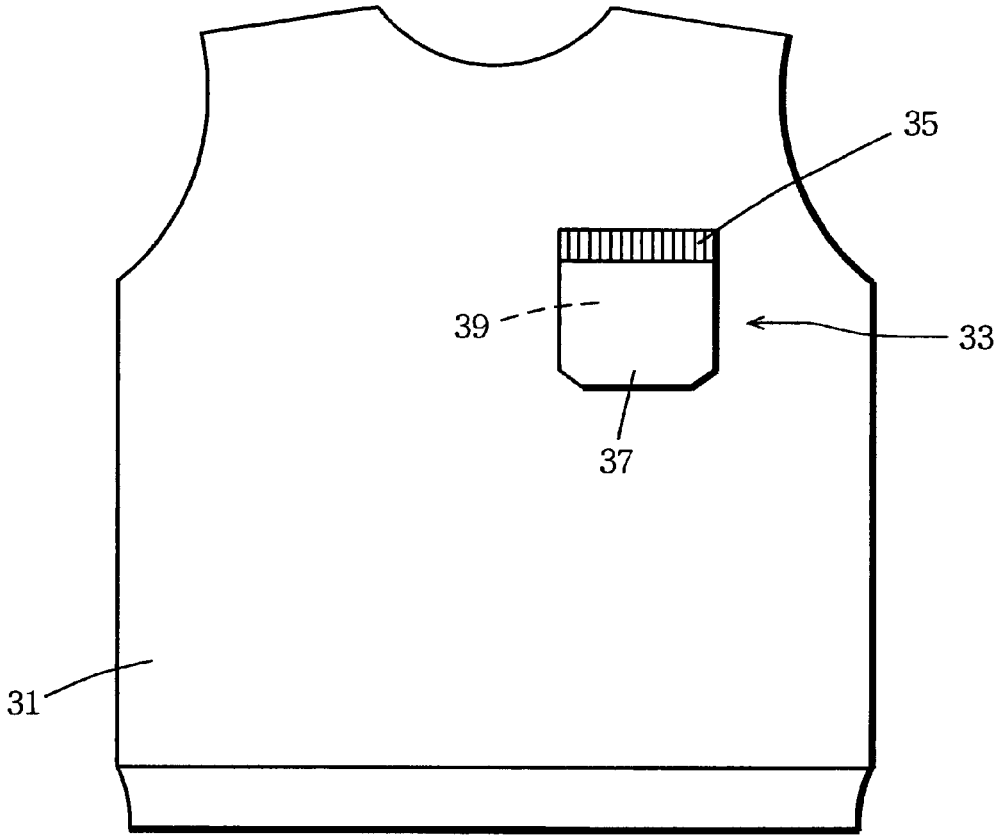
FIG. 6 shows a front body with a pocket of which opening is rib-knitted, as Application 2.
Figure 7:
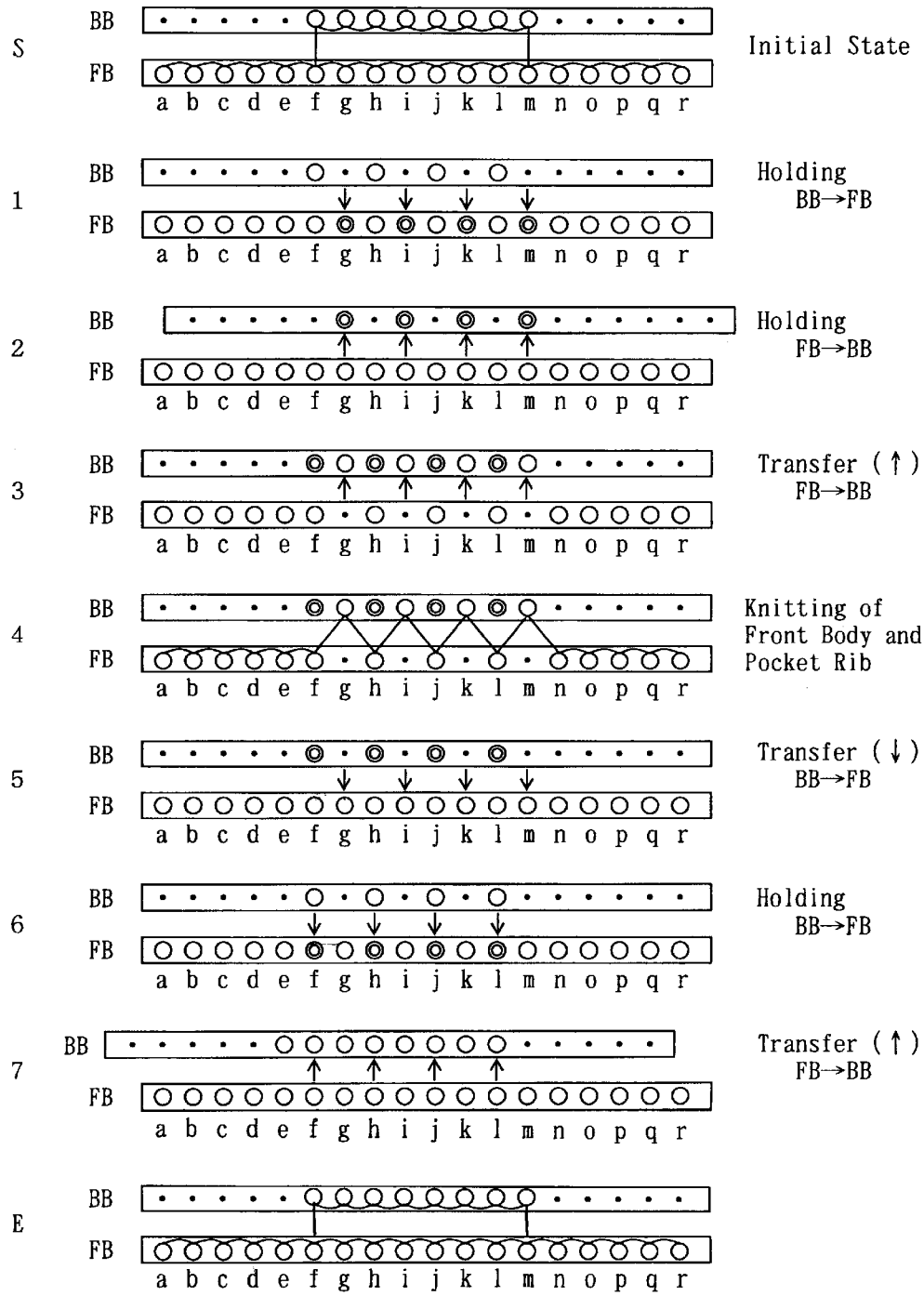
FIG. 7 shows knitting steps of the pocket rib part.

Next, a case is shown wherein a front body 31 with a pocket 33 is knitted and a rib-knit part is formed around the pocket rib part 35. FIG. 6 shows the knitted fabric when knitting is completed, and FIG. 7 shows the knitting steps of the pocket rib part 35. The front body 31 and the face part 37 of the pocket are knitted by using needles of the front needle bed FB, and the part 39 that is behind and concealed by the pocket is knitted with back stitch by using the needles of the back needle bed BB. The pocket bag is connected, on both sides in the direction of its depth, with the front body by the well-known method, and the pocket is knitted into a closed bag form except the pocket rib part 35. S in FIG. 7 shows the state of keeping of stitch loops on the respective needle beds, immediately before knitting the pocket rib part that is to be rib-knitted.

Steps 1~3 show preparatory steps for rib-knitting the pocket rib part 35, including holding of stitch loops. First, the stitch loops of the back part 39 of the pocket, that are kept on the needles g, i, k, m of the back needle bed BB, are moved to and held on the needles g, i, k, m of the front needle bed FB. Then in the next step 2, these stitch loops are moved to and held on the needles f, h, j, l of the back needle bed BB. As a result, all the stitch loops of the back part 39 of the pocket are now kept on the needles f, h, j, l of the back needle bed BB, and the needles g, i, k, m of the back needle bed BB are empty. Next, in step 3, the stitch loops of the face part 37 of the pocket, that are kept on the needles g, i, k, m of the front needle bed FB, are moved to and held on the needles g, i, k, m of the back needle bed BB. With this step, the preparation for rib-knitting the pocket rib part 35 is completed.

Step 4 shows knitting of the stitch courses of the body 31 and the pocket rib part 35. The yarn is fed to the needles a~e of the front needle bed, that are keeping the body 31, the needles f, h, j, l of the front needle bed FB and the needles g, i, k, m of the back needle bed BB, that are to form the pocket rib part 35, and the needles n~r keeping the body 31 to form a stitch course. This knitting is repeated to rib-knit the pocket rib part 35 of the desired height and form the stitch courses of the front body 31. When knitting of the pocket rib part 35 is completed, in step 5, the back stitches of the rib-knitted pocket rib part 35 are transferred from the needles g, i, k, m of the back needle bed BB to the needles g, i, k, m of the front needle bed FB. Next, in step 6, the stitches of the back part 39 of the pocket, that have been held on the needles f, h, j, l of the back needle bed BB, are moved to and held on the needles f, h, j, l of the front needle bed FB, then, in the subsequent step 7, the back needle bed BB is racked, and the stitch loops are transferred back to the needles g, i, k, m of the original needle bed BB. E of FIG. 7 shows the state of keeping of the stitch loops when the above-mentioned knitting is completed. As for the subsequent knitting, the stitch loops of the last course of the pocket rib part 35 are treated against getting loose by an appropriate method, and they are released from the needles. Then the stitch loops of the back part 39 of the pocket are transferred to the front needle bed FB to knit the stitch courses of the front body 31 on the front needle bed FB. If the last course of the pocket rib part 35 is to be treated against loosing by binding off, binding off is given after completion of knitting of the pocket rib part 35 in step 5.

Example that Uses Transfer Jack

Figure 8:
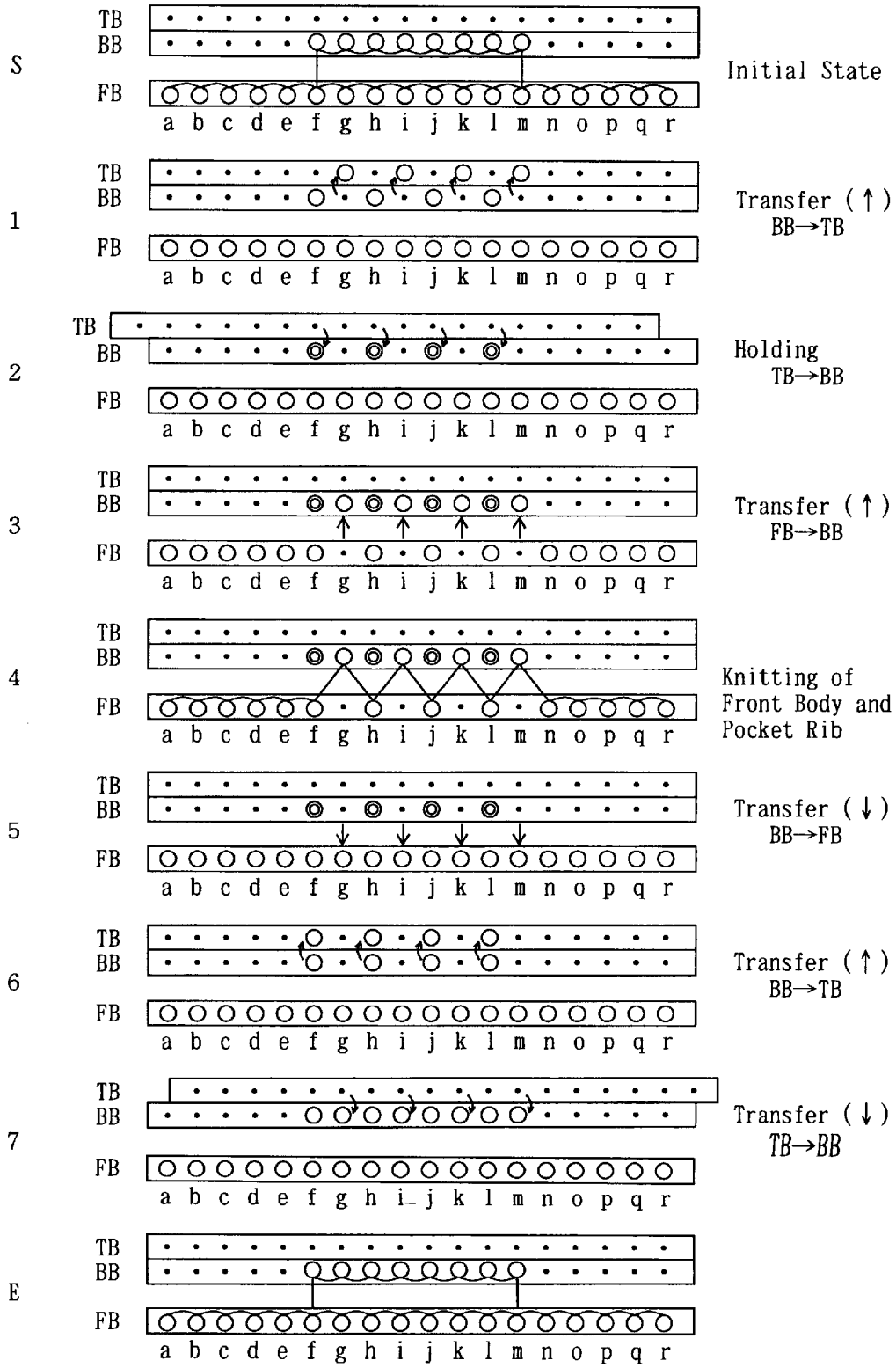
FIG. 8 shows knitting steps of a modification in which transfer jacks are sued for holding.

FIG. 8 shows a knitting that corresponds to FIG. 7, in which the above-mentioned knitting is made with transfer jacks. In steps 1, 2, transfer jacks of the transfer jack bed TB are used to hold the stitch loops of the back part 39 of the pocket on the needles f, h, j, l of the back needle bed BB, and in steps 6, 7, the stitch loops that have been held are returned to their initial needles.

Application 3

Figure 9:
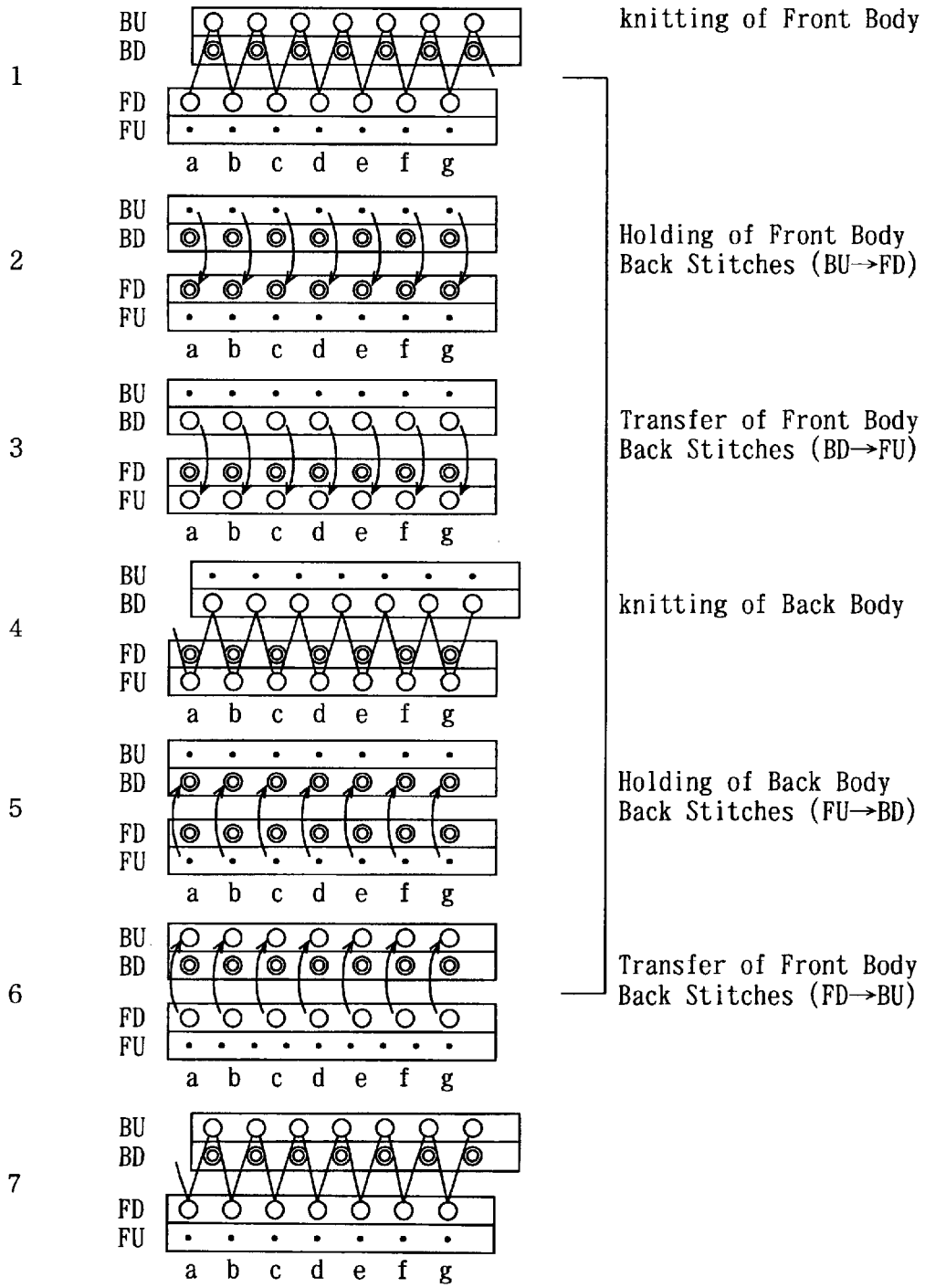
FIG. 9 shows knitting steps for knitting a tubular fabric of full rib knit.

Next, a case is shown wherein a front fabric and a back fabric, both being of full rib stitch structure, are connected on both sides to knit a tubular knitting. FIG. 9 shows the knitting steps thereof. The flat knitting machine used in the present embodiment is a four-needle-bed flat knitting machine wherein a pair of needle beds are arranged over a pair of front and back needle beds.

In step 1, the needles a, b, c, . . . of the front lower needle bed FD and the needles a, b, c, . . . of the back upper needle bed BU are used to knit a course of the front fabric of full rib-knit structure. At this time, as shown in FIG. 9, face stitch loops of the back fabric are kept in the hooks of the needles a, b, c, . . . of the back lower needle bed BD, and the back stitch loops of the back fabric are held on the tongues of the sliders of the same needles. Next, in succession to knitting of the course of the front fabric, to knit a course of the back fabric, first, in step 2, the back stitch loops of the front fabric, that were knitted on the needles of the back upper needle bed BU, are moved to and held on the tongues of the sliders of the respective needles of the front lower needle bed FD. After that, in step 3, the back stitch loops of the back fabric, that have been held on the tongues of the sliders of the needles of the back lower needle bed BD, are transferred onto the needles of the front upper needle bed FU. In step 4, the needles a, b, c, . . . of the back lower needle bed BD and the needles a, b, c, . . . of the front upper needle bed FU are used to knit the course of the back fabric. In subsequent steps 5~7, knitting of a course of the front fabric, that is made in succession to knitting of the course of the back fabric, is made. In step 5, the back stitch loops of the back fabric are held on the needles of the back lower needle bed BD. In the next step 6, the back stitch loops of the front fabric, that have been held on the needles of the front lower needle bed FD, are moved to and held on the needles of the back upper needle bed BU. Then in step 7, a course of the front fabric is knitted. The above-mentioned steps 1~6 of knitting are repeated to knit a tubular fabric of full rib-knit structure.

Figure 10:
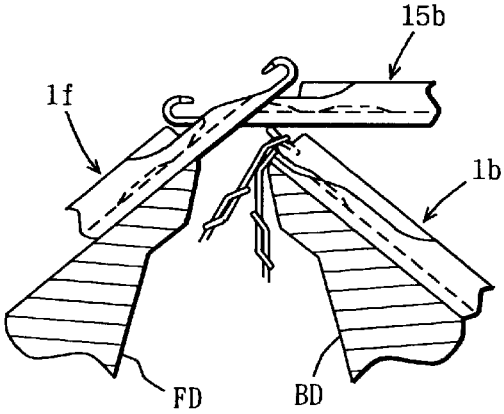
FIG. 10 shows the state of holding of a stitch loop during knitting of a tubular fabric of full rib knit, as Application 3.

In the above-mentioned application 3, as shown in FIG. 10, a stitch loop of one fabric of the front and back fabrics comprising the tubular knitting is held on either the front bed or the back bed of the lower needle beds FD, BD; on the back lower needle bed here. The other fabric of the tubular knitting is knitted by using the needle 1*f* of the front lower needle bed FD, on which the stitch loop is not held, and the needle 15*b* of the back upper needle bed BU, both needles 1*f*, 15*b* opposing each other with the trick gap in between. Depending on the arrangement of the upper beds, when a needle of an upper needle bed is moved forward towards the trick gap, the needle being directly above the needle of the lower needle bed on which a stitch loop is held, the needle may collide against the needle of the lower needle bed. In such a case, it is required to move the slider backward to an extent that the stitch loop will not come off the tongue of the needle on which the stitch loop is held, or to provide the flat knitting machine with a mechanism for shifting the lower needle bed to a retreating position that is away from the trick gap, so as to avoid the collision of the needles.

As described above, when the method for holding a stitch loop according to the present invention is applied to a flat knitting machine with four needle beds, knittings can be produced that could not be done in the past with the flat knitting machine with four needle beds.

Three specific examples of knitting wherein the method for holding a stitch loop according to the present invention is used were described above. The present invention, however, is not limited to these specific examples, and the present invention can be applied to a variety of knittings, including, for example, knitting a links pattern in a tubular knitting, and an internal narrowing of a rib-knitted fabric.

I claim:

1. A method for holding a stitch loop using a flat knitting machine wherein a large number of compound needles, each comprising a needle proper with a hook at a top end thereof and a slider having a tongue including two thin plates put together, are arranged in at least one first bed, the needle proper and the slider of each compound needle are individually movable forward and backward, at least one second bed with a large number of knitting members is provided, and said compound needles are made to advance from the first bed, and said knitting members are made to advance from the second bed to cross said compound needles and said knitting members with each other, and a region where said compound needles and said knitting members cross form a trick gap, said method for holding a stitch loop including a: moving a knitting member keeping a stitch loop from the second bed and the stitch loop into the trick gap;

b: moving both the needle proper and the slider of a compound needle forward into the trick gap and inserting both said hook and said tongue into the stitch loop kept by the knitting member of step a, and c: moving backward the knitting member referred to in step a and placing the stitch loop onto the tongue of the compound needle of step b.

2. A method for holding a stitch loop of claim 1 wherein in said step b and step c, another stitch loop is kept on the hook of said compound needle referred to in steps b and c.

3. A method for holding a stitch loop of claim 1 wherein said method further includes, in succession to said step c, d: moving backward both the needle proper and the slider of the compound needle referred to in step b;

e: knitting another stitch with the knitting member of step c;

f: moving the slider of step d forward into the trick gap;

g: moving the knitting member of step e forward into the trick gap and inserting a top end thereof between two thin plates forming the tongue of the slider of step f; and h: moving the slider of step g backward and transferring said stitch loop to the knitting member of step g.

4. A method for holding a stitch loop of claim 1 wherein in said second bed, a large number of compound needles are arranged as knitting members, each compound needle comprising a needle proper with a hook at a top end thereof and a slider having a tongue consisting of two thin plates put together, and said step a includes, with said stitch loop being kept on the hook of the compound needle of the second bed, moving forward the needle proper of the compound needle of the second bed, then moving forward the slider of the compound needle of the second bed, and shifting, during this time, said stitch loop from the hook of said needle proper onto the tongue of said slider, and said step b includes inserting both the hook and the tongue of the compound needle of the first bed between two thin plates forming the tongue of the slider of the compound needle of said second bed, and said step c includes moving the slider of the compound needle of said second bed backward.

5. A method for holding a stitch loop of claim 1 wherein each knitting member is a transfer jack, and said second bed is a transfer jack bed in which a large number of said transfer jacks are arranged.

6. A method for holding a stitch loop using a flat knitting machine wherein a large number of compound needles, each comprising a needle proper with a hook at a top end thereof and a slider having a tongue including two thin plates disposed in parallel, are arranged in at least one first bed, the needle proper and the slider of each compound needle are individually movable forward and backward, at least one second bed with a large number of knitting members is provided, and said compound needles are made to advance from the first bed, and said knitting members are made to advance from the second bed to cross said compound needles and said knitting members with each other, and a region where said compound needles and said knitting members cross form a trick gap, said method for holding a stitch loop including a: moving a knitting member keeping a stitch loop from the second bed and the stitch loop towards the trick gap;

b: moving both the needle proper and the slider of a compound needle forward towards the trick gap and inserting at least said tongue into the stitch loop kept by the knitting member of step a, and c: moving backward the knitting member referred to in step a and placing the stitch loop onto the tongue of the compound needle of step b.

7. A method for holding a stitch loop of claim 6 wherein in said step b and step c, another stitch loop is kept on the hook of said compound needle referred to in steps b and c.

8. A method for holding a stitch loop of claim 6 wherein said method further includes, in succession to said step c, d: moving backward both the needle proper and the slider of the compound needle referred to in step b;

e: knitting another stitch with the knitting member of step c;

f: moving the slider of step d forward into the trick gap;

g: moving the knitting member of step e forward into the trick gap and inserting a top end thereof between two thin plates forming the tongue of the slider of step f; and h: moving the slider of step g backward and transferring said stitch loop to the knitting member of step g.

9. A method for holding a stitch loop of claim 6 wherein in said second bed, a large number of compound needles are arranged as knitting members, each compound needle comprising a needle proper with a hook at a top end thereof and a slider having a tongue consisting of two thin plates disposed in parallel;

said step a includes, with said stitch loop being kept on the hook of the compound needle of the second bed, moving forward the needle proper of the compound needle of the second bed, then moving forward the slider of the compound needle of the second bed, and shifting, during this time, said stitch loop from the hook of said needle proper onto the tongue of said slider;

said step b includes inserting at least the tongue of the compound needle of the first bed between two thin plates forming the tongue of the slider of the compound needle of said second bed; and said step c includes moving the slider of the compound needle of said second bed backward.

10. A method for holding a stitch loop of claim 6 wherein each knitting member is a transfer jack, and said second bed is a transfer jack bed in which a large number of said transfer jacks are arranged.

* * * * *